US005634583A

United States Patent [19]

McGuinness et al.

[11] Patent Number: 5,634,583

[45] Date of Patent: Jun. 3, 1997

[54] ROOFING GUN ATTACHMENT FOR DISPENSING TIN TAGS

[75] Inventors: Thomas J. McGuinness, Jupiter; James M. McGuinness, Tequesta, both of Fla.; John R. Schneller, Brightwaters, N.Y.

[73] Assignee: 3J Design, Inc., Jupiter, Fla.

[21] Appl. No.: 456,861

[22] Filed: Jun. 1, 1995

[51] Int. Cl.[6] ..... B25C 7/00; B25C 1/04

[52] U.S. Cl. ..... 227/120; 227/99; 227/119; 227/138

[58] Field of Search ..... 227/120, 119, 227/138, 99

[56] References Cited

U.S. PATENT DOCUMENTS

| | | | |
|---|---|---|---|
| 2,385,521 | 9/1945 | Mead | 144/250.26 |
| 2,886,815 | 5/1959 | Young | 227/120 |
| 3,595,460 | 7/1971 | Pitkin | 227/48 |
| 3,734,377 | 5/1973 | Munn | 227/120 |
| 3,935,983 | 2/1976 | Buttriss | 227/110 |
| 4,058,464 | 11/1977 | McGovern et al. | 81/57.41 |
| 4,182,474 | 1/1980 | Sato | 227/99 |
| 4,246,939 | 1/1981 | Boegel | 29/771 |
| 4,339,065 | 7/1982 | Haytayan | 227/8 |
| 4,657,167 | 4/1987 | Mays | 227/99 |
| 4,890,968 | 1/1990 | Beach et al. | 411/531 |
| 4,998,662 | 3/1991 | Hasan et al. | 227/111 |
| 5,042,142 | 8/1991 | Beach et al. | 227/120 X |
| 5,056,684 | 10/1991 | Beach et al. | 227/120 X |
| 5,184,752 | 2/1993 | Zylka et al. | 221/1 |
| 5,255,485 | 10/1993 | Lemke et al. | 52/410 |

*Primary Examiner*—Scott A. Smith
*Assistant Examiner*—Jay A. Stelacone
*Attorney, Agent, or Firm*—Laubscher & Laubscher

[57] ABSTRACT

A tin tag dispensing apparatus for a nailing gun includes a support member having a tin tag dispensing groove, a shuttle slidably disposed within the support member, a tube receptacle containing a plurality of stacked tin tags, a slide member slidably mounted on the tube receptacle, a linkage assembly connecting the slide member with the shuttle, and a mounting plate for connecting the apparatus to the nailing gun. When the gun is lifted, the slide member slides upward along the tube receptacle and causes the shuttle, through the linkage, to engage and displace a single tin tag resting in the tin tag dispensing groove to a nailing station where it is retained until pierced by a fastener discharged from the nail gun.

16 Claims, 3 Drawing Sheets

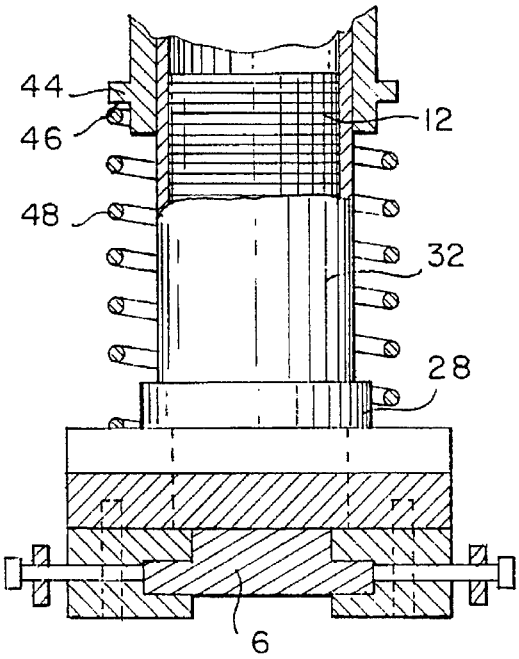
FIG. 5
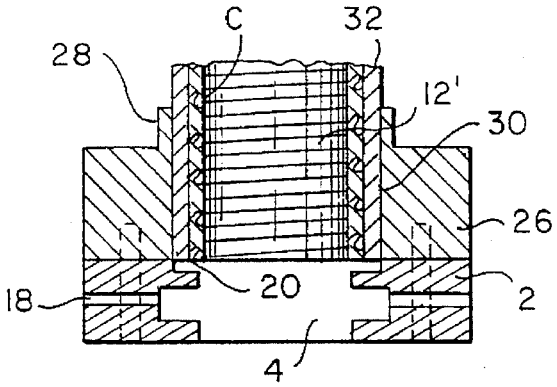
FIG. 11
FIG. 6
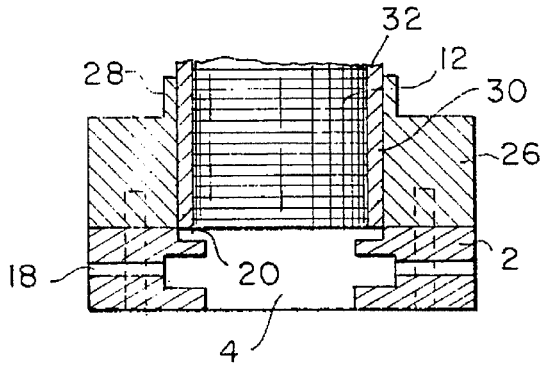
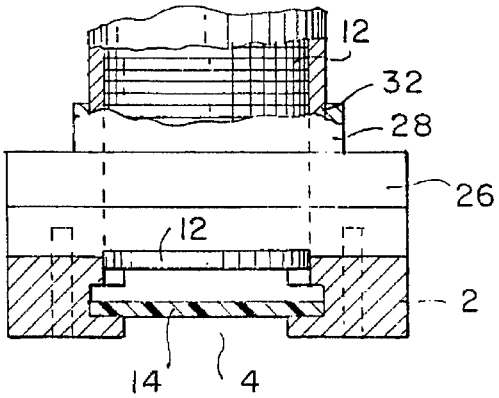
FIG. 7

ROOFING GUN ATTACHMENT FOR DISPENSING TIN TAGS

BACKGROUND OF THE INVENTION

1. Field of Invention

This invention relates to dispensing attachments for tools and, in particular, to an attachment for a hand-held, pneumatically-operated nailing gun which individually dispenses tin tags which are fastened to a roof by a fastener discharged from the nailing gun.

2. Brief Description of the Prior Art

The building code in certain jurisdictions requires tin tags (also referred to as roofing washers, plates or disks) to be placed at specified distances on the roof to securely fasten an overlay of black paper or the like to a wooden roof structure. It is currently the custom to hand place the tin tags on the overlay and to nail the tin tag to the roof using a pneumatically-operated hand-held nailing gun such as the Hitachi Nailer, Model NV45AB. This method, however, has several disadvantages and drawbacks. Because the typical tin tag has a diameter of approximately 1.625 inches, it is difficult for the nailing gun operator to center the nail on the tin tag. If too far off center, the nail causes the edges of the tin tag to become raised and these raised edges can then puncture the overlay. Also, hand placement of the tin tags presents a serious safety hazard to the user of the gun. Since the tin tag is placed by hand, the operator's fingers are frequently near the barrel of the nailing gun and it is not uncommon for the nailing gun operator to inadvertently shoot a nail into his finger.

Attachments to air powered tools for dispensing workpieces into a position where they can be pierced by a fastener driven by the tool are known in the patented prior art, as evidenced by the patents to Munn U.S. Pat. No. 3,734,377, and to Beach et al, U.S. Pat. No. 5,042,142.

The Munn patent discloses a part feeding attachment combined with a hand-held pneumatically-powered driving tool which advances one part at a time into position for piercing by a fastener delivered by the tool. This device uses the residual exhaust air pressure from the driving tool to actuate a pneumatically operated driver mechanism which is connected to a feeder which engages a single metal disk and positions it for piercing by the next succeeding fastener driven by the tool.

The Beach et al patent discloses a stand-up screw gun which individually dispenses stacked roofing washers and drives a fastener therethrough. This machine, however, requires a special ribbed washer designed to prevent the washers from adhering in order to operate without jamming.

These devices have not achieved wide spread use in the roof construction industry because they require alteration or modification to the commercially available nailing guns currently used in the roofing industry, must he purchased as a preassembled integral unit with a new nailing gun, are prone to jamming, or cannot be used with commercially available tin tags.

There remains a need, therefore, for a light weight dispensing attachment which can be easily connected and disconnected from the hand-held roofing guns currently being used in the roofing industry and which can operate using commercially available tin tags without jamming. The present invention was developed to overcome these and other drawbacks of the prior art devices.

SUMMARY OF THE INVENTION

Accordingly, a primary object of the present invention is to provide an improved roofing gun attachment which can be easily retrofit to existing nailing guns and which is operable to dispense commercially available tin tags. More particularly, it is an object of the present invention to provide a tin tag dispensing apparatus including a support member having a tin tag dispensing groove for receiving a single roofing washer and a slot for receiving a shuttle, a tube for containing a plurality of stacked roofing washers, a slide member connected with the nailing gun, and a linkage assembly, whereby when the nailing gun is lifted, the slide member slides upward along the tube and causes the shuttle, through the linkage assembly, to engage the lower most tin tag and move it to a nailing position where it is held until pierced by a nail discharged from the nailing gun.

BRIEF DESCRIPTION OF THE DRAWINGS

Other objects and advantages of the invention will become apparent from a study of the following specification, when viewed in the light of the accompanying drawings, in which:

FIG. 5 is a sectional view taken along line 5—5 of FIG. 1;

FIG. 6 is a sectional view taken along line 6—6 of FIG. 1;

FIG. 7 is a sectional view taken along line 7—7 of FIG. 1;

FIG. 11 is a detailed view of a modification wherein the tin tags are contained with a cartridge.

DETAILED DESCRIPTION

Figures 1, 2, 3, 4:
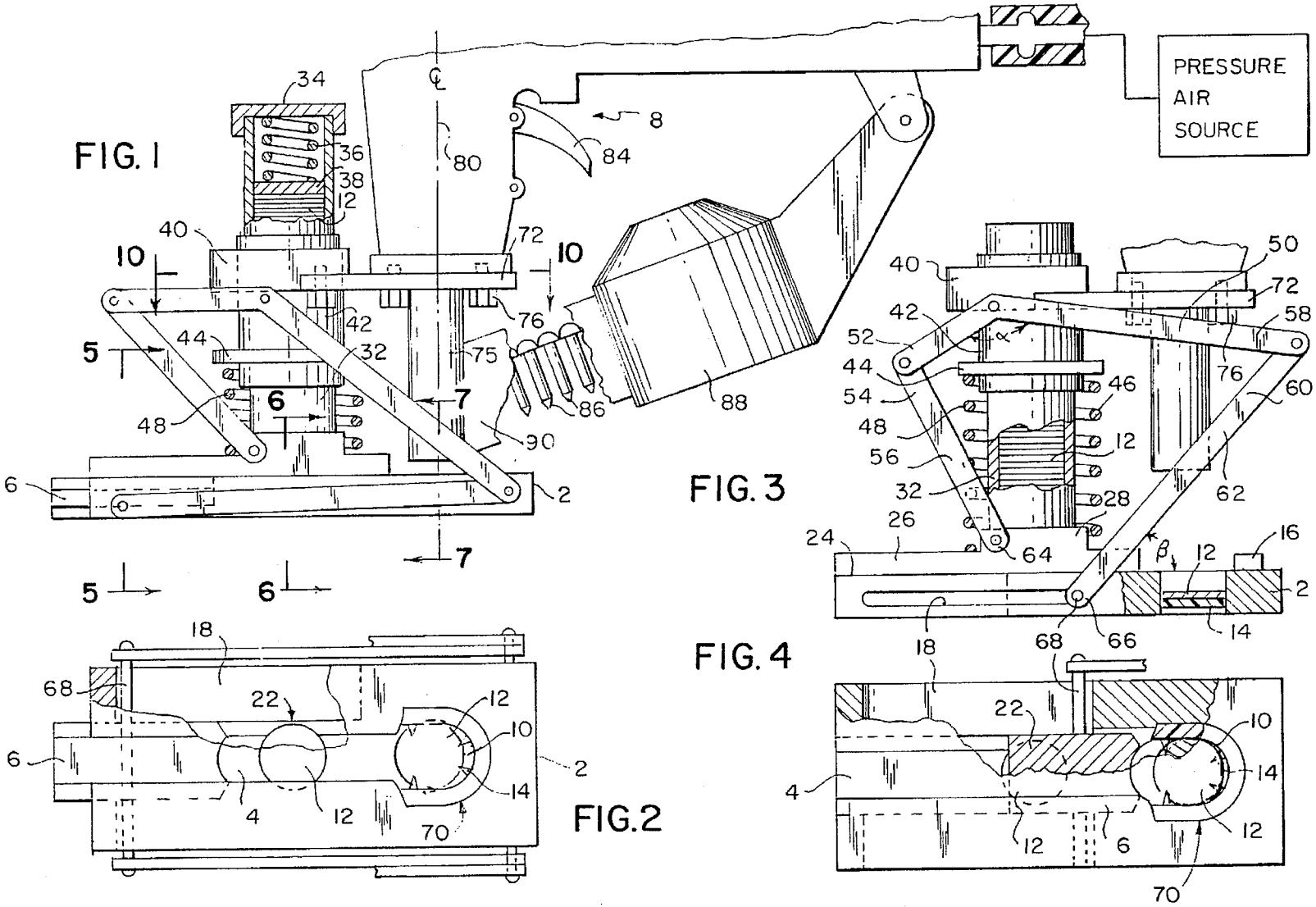
FIG. 1 is a partial sectional side view of the apparatus of the present invention with the shuttle adjacent the tag loading station.
FIG. 2 is a top view of the support member with the shuttle in the FIG. 1 position.
FIG. 3 is a partial sectional side view of the present invention with the shuttle adjacent the tag-nailing station.
FIG. 4 is a top view of the support member with the shuttle in the FIG. 3 position.
Figure 9:
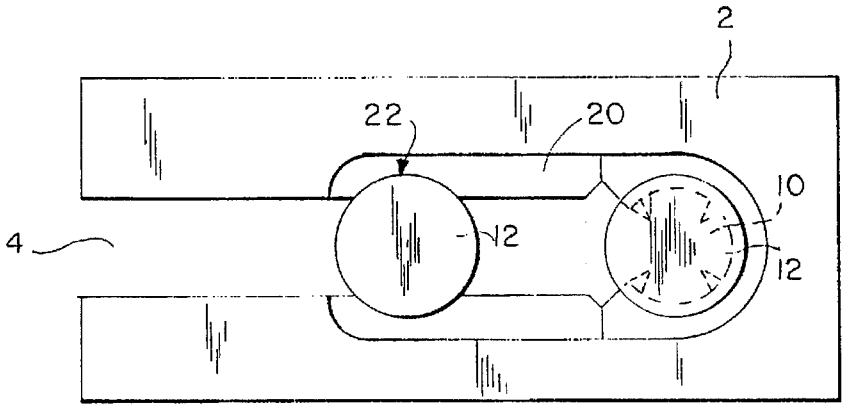
FIG. 9 is a top view of the support member.

Referring first more particularly to FIGS. 1 and 2, the tin tag dispensing apparatus of the present invention includes tin tag support member 2 which includes a longitudinally extending slot 4 adapted to slidably receive a shuttle 6. At the end adjacent the nailing gun 8, the support member contains a through bore 10 adapted to receive and hold a planar circular tin tag 12. The tin tag is releasably held in the through bore by any suitable retaining means, such as flexible teeth 14 formed of an elastomeric material, a magnet 16, or coiled metallic springs (not shown). Slots 18 extend along each side of the support member in communication with the longitudinal slot 4. A shallow tin tag dispensing groove 20 adapted to receive a single tin tag extends from the through bore 10 to a tin tag loading station 22 as best shown in FIG. 9.

Bolted to the top surface 24 of the tin tag support member 2 is an adapter plate 26 having a raised portion 28 containing a through bore 30 as shown in FIG. 6 which allows the tin tags 12 to feed into the tin tag dispensing groove 20. The adapter plate 26 and tin tag support member 2 are formed by two separate members which are bolted together rather than as one piece so that the tin tag dispensing groove 20 can be machined to a tolerance sufficient to receive an individual tin tag without becoming jammed. For example, by using a standard tin tag having a thickness of 0.012 inches, a tin tag dispensing groove depth of 0.014 inches has been found to allow a single till tag to be dispensed. It will be recognized that if the groove is too deep, more than one tin tag will be dispensed and if the groove is too shallow, the tin tags will tend to jam. It was found that a groove depth of 0.014 inches could be machined to the necessary tolerance only by first machining the groove into the support member and then fastening the adapter plate thereto.

The raised portion 28 of the adapter plate is adapted to receive a cylindrical tube receptacle 32 which contains a plurality of stacked tin tags 12. A cap 34 is fastened to the top of the tube to prevent tin tags from spilling if the apparatus is tilted. The tin tags can be gravity fed if the apparatus is used only on a relatively horizontal surface, or can be spring-loaded by a spring 36 contained within the tube receptacle which at one end contacts the cap and at the other end includes a biasing member 38 which biases the stack of tin tags toward the tin tag dispensing groove 20.

Figure 10:
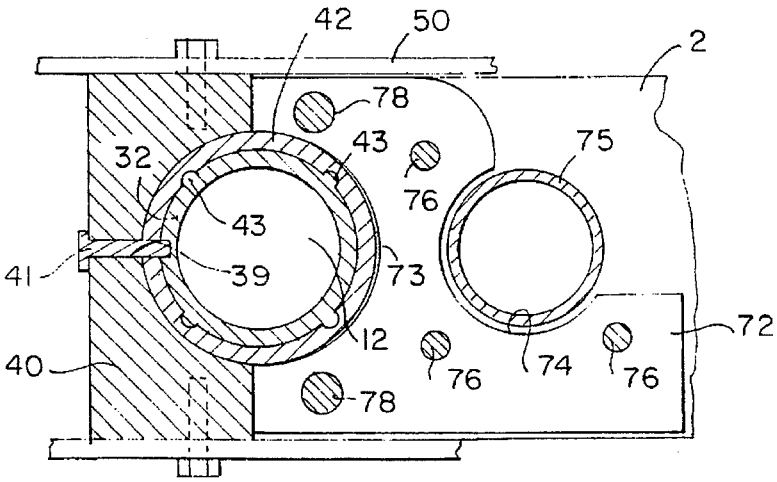
FIG. 10 is a sectional view taken along line 10—10 of FIG. 1.

Slidably mounted around the tube 32 is a slide member 40 which includes a tubular sleeve 42 extending above and below the slide member adjacent the tube. The sleeve 42 fits around tube 32 with minimal play so as to prevent unwanted pivoting or rocking motion of slide member 40 yet still allow slide member 40 to slide freely along the tube. Additionally, the sleeve length is sufficient to further minimize any unwanted pivoting motion of slide member 40 relative to the tube 32. To further facilitate sliding movement of slide member 40, the coefficient of friction between the sleeve inner surface and the tube outer surface is low. This allows the slide member to move relatively uninhibited by longitudinally along the tube. As shown in FIG. 10, tube 32, sleeve 42, and slide member 40 include a keyway slot 39 adapted to receive an adjustable key 41 which prevents spinning or twisting movement of the slide member relative to the tube. Alternatively, the sleeve 42 and tube 32 can also include longitudinally mating spline connections 43 to prevent spinning or twisting movement of the slide member relative to the tube. The portion extending below the slide member 40 includes a laterally extending flange portion 44, the lower surface 46 of which contacts a helical compression spring 48 arranged concentrically the tube. The recoil spring 48 acts to bias the slide member 40 away from the adapter plate 26; that is, it provides a recoil action between the slide member and adapter plate/support member assembly.

Pivotally mounted on the slide member is a first angled linkage member 50 which has a first end 52 connected with a first end 54 of a second linkage member 56, and a second end 58 connected with a first end 60 of a third linkage member 62. A second end 64 of the second linkage member 56 is pivotally connected with the raised portion 28 of the adapter plate. A second end 66 of the third linkage member 62 is connected with an axle 68 which extends through slots 18 and connects with the shuttle 6.

The linkage assembly 50, 56, and 62, is constructed so that when the apparatus is in the tag-nailing position shown in FIGS. 3 and 4 with the shuttle adjacent the through bore 10, the third linkage member 62 forms an angle $\beta$ with the support member 2 of less than 45 degrees. At such an angle, it will be recognized that as slide member 40 moves downward along the tube 32, linkage member 62 will impart a horizontal force on shuttle 6 greater than the vertical force, thereby facilitating sliding action of the shuttle within the transverse slot 4 in the direction away from the through bore 10. To achieve an angle $\beta$ less than 45 degrees and to achieve the necessary travel distance for the shuttle between the loading station 22 and nailing station 70 for the available stroke distance of the slide member 40 along the tube 32, the first linkage member 50 is formed having an angle $\alpha$ of approximately 135 degrees.

If the apparatus is constructed using a heavy material such as aluminum or stainless steel, the weight of the adapter plate/support member/tube assembly will cause the slide member to slide upwardly on the tube as the nailing gun is lifted. If, however, the apparatus is constructed using a light-weight material such as a high strength synthetic plastic, ceramic or composite material, supplemental biasing means (such as helical spring 48 or torsion springs, not shown) placed in the joints between the first and second linkage members, first and third linkage members, or second linkage member and the adapter plate must be employed.

Connected with the slide member 40 is a mounting plate 72. As best shown in FIG. 10, the mounting plate 72 includes a semi-circular portion 73 adapted to receive the tubular sleeve 42, and an opening 74 through which the nailing gun barrel 75 is placed. The nailing gun is bolted to the mounting plate via bolts 76 and to the slide member via bolts 78 such that the nailing axis 80 of the gun is always aligned with the through bore 10. In this manner, the apparatus can be quickly disconnected from the nailing gun by simply loosening bolts 78. Only the mounting plate 72 remains attached to the gun. With the apparatus disconnected, the nailing gun can be used to nail shingles or for other tasks not requiring the tin tag dispensing apparatus. In addition, the same tin tag dispensing apparatus can be attached to any pneumatically operated hand-held nailing guns provided the nailing gun includes the proper mounting plate.

OPERATION

When the roofing gun is placed against a fixed surface, it will assume the loading/nailing position shown in FIGS. 1 and 2. While in this position, cap 34 is removed from the tube receptacle 34 which is manually loaded with tin tags 12. Alternatively, the tin tags can be packaged in a cartridge (not shown) adapted to fit within the tube. Once loaded, the lowermost tin tag will be fed by gravity to tin tag dispensing groove 20. The cap is then reattached and the loading spring 36 biases the tin tags toward groove 20.

Figure 8:
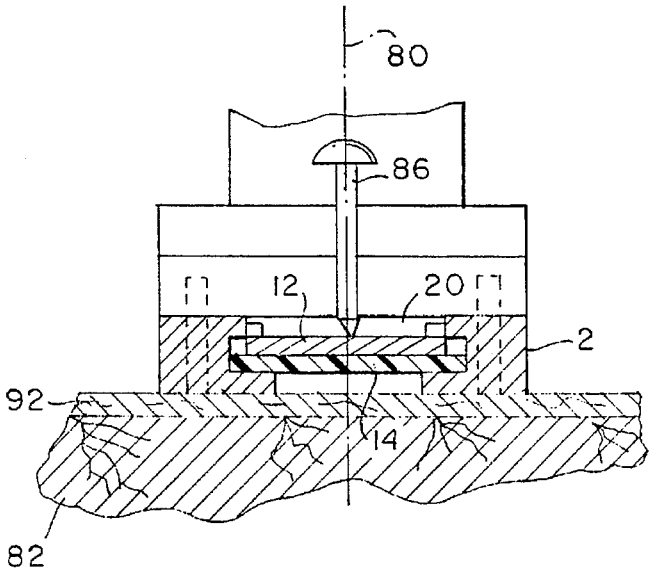
FIG. 8 is a sectional view illustrating the nailing operation of the invention.

When the gun is lifted, the slide member 40 slides upward along the tube 32 away from the adapter plate 26. As the slide member travels upward, the shuttle 6, via the linkage assembly, travels from the loading position shown in FIGS. 1 and 2 to the nailing position shown in FIGS. 3 and 4. As the shuttle travels along the transverse slot 4, it engages the lowermost tin tag resting at the loading station 22 and pushes it along groove 20 to the nailing station 70. When the tin tag reaches the nailing station, it is engaged and held by retaining member 14. The apparatus is then placed on a fixed workpiece 82, shown in FIG. 8, and the nailing gun is lowered to the nailing position shown in FIGS. 1 and 2. When the trigger 84 of the nailing gun is manually actuated by the operator, a nail 86 from the nail cartridge 88 is fed through chute 90 to the nailing gun barrel 75 where it is discharged, by high pressure air, from the nailing gun barrel and through the tin tag being held at the nailing station. The nail pierces the tin tag, passes through the black paper overlay 92 and into the fixed workpiece, thereby fastening the tin tag and overlay to the fixed workpiece 82. It will be recognized that because the nailing axis is aligned with the center of the tin tag, the nail will always pierce the center of the tin tag. While the tin tags have been illustrated as being arranged as a loose stack in FIGS. 1–10, as shown in FIG. 11, the tin tags 12' may be arranged in a cartridge C adapted to fit within the tube receptacle 32.

While in accordance with the provisions of the Patent Statutes the preferred form and embodiments of the invention have been illustrated and described, it will be apparent to those skilled in the art that various changes and modifications may be made without deviating from the inventive concept set forth above.

What is claimed is:

1. Apparatus for positioning a generally planar tin tag relative to a roofer's nailing gun having a discharge end with a given nail driving axis for driving a nail through the tin tag and into a fixed workpiece, comprising:

(a) a horizontal support member (2) adapted to be seated on the workpiece, said support member containing an opening (10) defining a nailing station (70), said support member including means defining a loading station (22);

(b) means for successively supplying tin tags (12) to said loading station, including a vertically arranged tubular supply receptacle (32) having a cross-sectional configuration corresponding generally with that of the tin tags, said receptacle having a lower end connected with said support member adjacent said loading station, and an open upper end for receiving a stack of the tin tags;

(c) means including a shuttle member (6) slidably connected with said support member for transporting a tin tag from said loading station to said nailing station;

(d) a tubular slide member (40) mounted concentrically about said supply receptacle for movement between upper retracted and lower nailing positions relative to said support member;

(e) spring means (48) biasing said slide member toward said upper retracted position relative to said support member;

(f) means (72) for connecting said slide member with the nailing gun to cause the gun nailing axis to extend through said nailing station opening; and (g) connecting means for connecting said slide, shuttle and support members for displacing said shuttle member between said nailing and loading stations when said slide member is displaced between said upper retracted and lower nailing positions, respectively, whereby when the user displaces said slide member and said nailing gun toward the support member against the biasing force of said spring, the slide member is displaced from the nailing station toward the loading station.

2. Apparatus as defined in claim 1, wherein said means for connecting said slide member with the nailing gun includes a mounting plate (72) containing an opening (74) for receiving the nail discharging end of the nailing gun.

3. Apparatus as defined in claim 1, wherein said support member contains a through bore defining said nailing station.

4. Apparatus as defined in claim 3, and further including resilient means for retaining a tin tag in said through bore.

5. Apparatus as defined in claim 3, wherein said support member contains a slot that extends between said loading and nailing stations, said shuttle member being slidably movable in said slot.

6. Apparatus as defined in claim 5, wherein said connecting means includes linkage means connecting said shuttle member for movement in said slot upon corresponding movement of said support member relative to said mounting plate.

7. A nailing gun attachment for successively dispensing tin tags for fastening to a fixed workpiece by a nail fastener discharged from the nailing gun, comprising:

(a) a generally rectangular horizontal support member (2) containing a longitudinal slot (4) extending between a loading station (22) and a nailing station (70) on said support member, said support member containing a nailing opening (10) defining said nailing station, said support member being adapted to be seated on the workpiece;

(b) a shuttle (6) slidably disposed within said slot for displacement between said loading and nailing stations;

(c) a vertical tube receptacle (32) having a lower end connected with said support member adjacent said loading station, said tube receptacle having an upper end adapted to receive a stack of tin tags;

(d) mounting means (40) slidably mounted on said tube receptacle for connecting the attachment to the nailing gun; and (e) linkage means (50, 56, 62) connecting said mounting means with said shuttle for displacing said shuttle between said nailing and loading stations as said mounting means and the nailing gun are displaced toward and away from said support member, respectively.

8. A nailing gun attachment as defined in claim 7, wherein said support member further includes a tin tag receiving groove for supporting a tin tag during the transport thereof by said shuttle from said tube receptacle to said nailing opening.

9. A nailing gun attachment as defined in claim 7, and further comprising stabilizing means for preventing twisting and pivoting movement of said mounting means relative to said tube receptacle.

10. A nailing gun attachment as defined in claim 7, and further comprising means for releasably retaining a tin tag in said nailing opening.

11. A nailing gun attachment as defined in claim 8, wherein said groove has a depth of about 0.014 inches.

12. A nailing gun attachment as defined in claim 7, wherein said linkage means comprises:

(a) a first link (50) having first and second ends, said first link being pivotally connected intermediate its ends with said mounting means;

(b) a second link (56) having a pair of ends pivotally connected with said support member and with said first end of said first link, respectively; and (c) a third link (62) having a pair of ends pivotally connected with said shuttle and with said second end of said first link, respectively.

13. A nailing gun attachment as defined in claim 12, wherein said first link includes a pair of arms (52, 58) arranged to define therebetween an angle of about 135 degrees.

14. A nailing gun attachment as defined in claim 12, wherein when said shuttle is adjacent said nailing opening, said third link defines an angle of less than 45 degrees relative to said support member.

15. A nailing gun attachment as defined in claim 7, and further comprising cartridge means (C) adapted to fit within said tube receptacle for containing a plurality of stacked tin tags.

16. A nailing gun attachment as defined in claim 7, wherein said mounting means comprises a slide member (40), and a mounting plate (72) for connecting said slide member to the nailing gun.

* * * * *